US009668591B2

(12) United States Patent
Giulietti

(10) Patent No.: US 9,668,591 B2
(45) **Date of Patent: *Jun. 6, 2017**

(54) DISPLAY

(71) Applicant: INDUSTRIE SCAFFALATURE ARREDAMENTI—ISA S.R.L., Bastia Umbra (PG) (IT)

(72) Inventor: Marco Giulietti, Bastia Umbra (IT)

(73) Assignee: INDUSTRIE SCAFFALATURE ARREDAMENTI—ISA S.R.L., Bastia Umbra (IT)

( * ) Notice: Subject to any disclaimer, the term of this patent is extended or adjusted under 35 U.S.C. 154(b) by 0 days.

This patent is subject to a terminal disclaimer.

(21) Appl. No.: 15/135,966

(22) Filed: Apr. 22, 2016

(65) Prior Publication Data

US 2016/0309919 A1 Oct. 27, 2016

(30) Foreign Application Priority Data

Apr. 27, 2015 (IT) ..... 102015000013261

(51) Int. Cl.

| | |
|---|---|
| ***A47F 3/04*** | (2006.01) |
| ***A47F 3/12*** | (2006.01) |
| ***E05F 17/00*** | (2006.01) |
| ***E05F 15/611*** | (2015.01) |
| *E05F 15/40* | (2015.01) |

(52) U.S. Cl.

CPC ..... *A47F 3/0478* (2013.01); *A47F 3/043* (2013.01); *A47F 3/125* (2013.01); *E05F 15/611* (2015.01); *E05F 17/004* (2013.01); *E05F 15/40* (2015.01); *E05F 2017/008* (2013.01); *E05Y 2201/46* (2013.01); *E05Y 2201/708* (2013.01); *E05Y 2600/52* (2013.01); *E05Y 2600/60* (2013.01); *E05Y 2900/202* (2013.01)

(58) Field of Classification Search

CPC ..... A47F 3/0434; A47F 3/0478; A47F 3/043; A47F 3/125; F25D 23/00; F25D 23/02; F25D 23/025; F25D 23/028; E06B 3/48; E06B 3/481; E06B 3/482; E05F 15/611; E05F 17/004

USPC ..... 312/116, 138.1, 139, 139.1, 324, 326; 62/440, 246, 249; 49/109, 110, 113, 118, 49/366; 160/185, 186, 199, 200

See application file for complete search history.

(56) References Cited

U.S. PATENT DOCUMENTS

| | | | | |
|---|---|---|---|---|
| 3,216,776 A | | 11/1965 | Carbary | |
| 4,341,083 A | * | 7/1982 | Ibrahim | A47F 3/043 49/340 |
| 6,470,952 B1 | * | 10/2002 | Cline | E05D 15/266 160/118 |

(Continued)

FOREIGN PATENT DOCUMENTS

EP 2525177 A1 11/2012

OTHER PUBLICATIONS

Search Report for corresponding Italian Application No. 102015000013261.

*Primary Examiner* — James O Hansen

(74) *Attorney, Agent, or Firm* — Egbert Law Offices, PLLC

(57) ABSTRACT

A display has at least one pair of revolving door panels hinged to a box frame by means of hinging means actuated by actuation means intended to permit the synchronous movement of the door panels of the pair of door panels.

13 Claims, 9 Drawing Sheets

(56) References Cited

U.S. PATENT DOCUMENTS

2012/0291471 A1* 11/2012 Giulietti ..... E06B 3/367
62/255

* cited by examiner

DISPLAY

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present patent application for industrial invention relates to a display, in particular a refrigerated display used to display food products. Although in the following description reference is made to a refrigerated display, the present invention is extended to any type of display.

2. Description of Related Art Including Information Disclosed Under 37 CFR 1.97 and 37 CFR 1.98.

Various types of refrigerated displays are known on the market to display food products. FIG. 1 is a perspective view of a display (100) comprising a box frame (1) that comprises a compartment (2) intended to contain foods in general and beverages to be refrigerated, and an opening (4) that provides access to said compartment (2). In correspondence of said opening (4) the display (100) comprises an upper crosspiece (12) and a lower crosspiece (13).

The display (100) comprises two pairs (C) of revolving door panels (3) intended to close the opening (4) of the box frame (1).

Each door panel (3) can be disposed in a plurality of positions comprised between an opening position, wherein the pairs (C) of door panels (3) provide access to the compartment (2), and a closing position, wherein the access to the compartment (2) is prohibited to preserve the internal temperature.

The pairs (C) of door panels (3) open towards the interior of the compartment (2) in such way that, in opening position, the door panels (3) are contained inside the compartment (2).

With reference to FIG. 2, which is a detailed view of one of the door panels (3) of one of said pairs (C) of door panels (3), each door panel (3) has a rectangular configuration and comprises:

- a first side (3*d*) directed towards the interior of the compartment (2) when the door panel (3) is in closing position,
- a second side (3*e*) directed towards the outside of the compartment (2) when the door panel (3) is in closing position,
- two vertical lateral edges (3*a*) in parallel position,
- an upper horizontal edge (3*b*) disposed in proximity to the upper crosspiece (12),

- a lower horizontal edge (3*c*) disposed in proximity to the lower crosspiece (13).

The two door panels (3) of each pair (C) are disposed in side by side position and hinged in correspondence of the opposite vertical edges (3*a*) in such a way to rotate in opposite direction around corresponding vertical axes of rotation (Y-Y).

Advantageously, said pairs (C) of door panels (3) are partially or fully transparent in order to allow the user to see the products contained in the compartment (2).

The display (100) comprises hinging means (7*a*) to hinge the door panels (3) to said box frame (1).

The hinging means (7*a*) are configured in such way that the door panels (3) rotate around the corresponding vertical axes (Y-Y) of rotation.

The hinging means (7*a*) comprise:

- an upper pin (73) that connects the door panel (3) to the upper crosspiece (12) of the box frame (1), and
- an idle lower pin (70) that connects the door panel (3) to the lower crosspiece (13) of the box frame (1).

With reference to FIG. 1, the display (100) comprises an actuation means (M1) for the automatic actuation of each door panel (3).

The actuation means (M1) actuate the hinging means (7*a*) to make the door panel (3) rotate around the axis of rotation (Y-Y); in particular, the actuation means (M1) are connected to the upper pin (73) of the hinging means of each door panel (3).

The upper pin (73) of the hinging means of a door panel (3) is actuated by the actuation means (M1) and permits the rotation of the door panel (3).

The display (100) comprises detection means (R) to detect the presence of the user in proximity to the door panel (3) and/or inside the compartment (2) of the display (100), as shown in FIG. 1.

The detection means (R) detect the presence of the user in proximity to one of the door panels (3) and send an activation signal, either directly or with a manual command, to the actuation means (M1) that consist in a set of electric motors, each of them comprising a drive shaft coupled to one of the upper pins (73) of the door panels (3); in view of the above, when a motor is actuated, the corresponding door panel (3) is rotated in the opening or closing direction according to the direction of rotation of the electric motor.

In case of a refrigerated display, the display (100) comprises means for cold air circulation, which are not shown in the figure, intended to refrigerate the interior of said compartment (2).

A first drawback of this type of known displays (100) consists in the difficulty encountered in synchronizing the simultaneous movement of the two door panels (3) of each pair (C) of door panels (3); such a drawback occurs when the two electric motors that are used to operate each pair (C) of door panels (3) are not perfectly synchronized originally or lose synchronization during operation.

A second drawback is related to the high purchasing and maintenance cost of the set of electric motors provided for the automatic actuation of the door panels (3).

Moreover, the door panels (3) are difficult to dismount given the fact that the upper pin (73) of each door panel (3) is firmly connected with the drive shaft of one of the electric motors.

An additional drawback of this kind of known displays (100) is related to the fact that the door panels (3) cannot be actuated if the actuation means (M1) are blocked.

The blocking of the electric motors can be caused either by a breakdown or a blackout.

Moreover, the door panels (3) are joined to the actuation means (M1) and consequently the incorrect operation of the actuation means (M1) would cause an incorrect actuation of the door panels (3).

Finally, another drawback is related to the fact that, in case of malfunctioning of the detection means (R), they would not identify the presence of the user's hand inside the compartment (2) and would consequently send an activation signal to the actuation means (M1) to enable the closing of the door panels (3), with the risk of injuring the user's hand by tightening it between the pair of door panels (3) automatically actuated in closing direction.

On the contrary, in case of malfunctioning, said detection means (R) would not identify the presence of a user in front of the door panels (3) and, consequently, would not send an activation signal to the actuation means (M1) to enable the opening of the door panels (3), thus preventing the user from accessing the compartment (2) and picking the desired product.

The main purpose of the present invention is to remedy the drawbacks of the prior art as described above by disclosing an improved display provided with actuation means for the pairs of door panels, which are able to solve the aforementioned problems with reference to the synchronization of the opening/closing movement of the door panels of each pair of door panels.

The second purpose of the present invention is to devise an improved display that is capable of operating also in case of breakdown or malfunctioning of the actuation means and of the detection means.

The third purpose of the present invention is to devise an improved display that, in addition to achieving the aforementioned purposes, is provided with actuation means for the automatic actuation of the door panels, which is able to avoid detrimental effects for the safety of the users or of the operators in charge of loading and maintaining the display of the invention.

BRIEF SUMMARY OF THE INVENTION

These purposes are achieved in accordance to the invention with the characteristics of the independent claim 1.

Advantageous embodiments of the invention will appear from the dependent claims.

The display of the invention comprises:

- a box frame that comprises a compartment and an opening to access said compartment;
- at least one pair of revolving door panels, adapted to close at least partially said at least one opening of the box frame; each door panel of said at least one pair of door panels being connected to the box frame, in such manner to be disposed in a closing position and in an opening position;
- hinging means to hinge said each door panel to said box frame; said hinging means being configured in such manner that said door panel rotates around an axis of rotation, being disposed in an opening position and in closing position; said hinging means comprising a pivoting pin used to connect and hinge each door panel to the box frame;
- actuation means that actuate said hinging means in order to rotate each door panel around said axis of rotation.

The peculiarity of said display consists in the fact that said actuation means comprise:

- an electric motor;
- a slide that is actuated by said electric motor and makes alternate rectilinear travels;
- a connecting rod connected to said slide;
- two cranks, of which one of said two cranks is connected to said connecting rod; each crank being connected to the first pivoting pin of one of said door panels of said at least one pair of door panels, in such way that each door panel is connected with only one crank;
- a transmission lever that connects said at least two cranks.

BRIEF DESCRIPTION OF THE SEVERAL VIEWS OF THE DRAWINGS

For purposes of clarity, the description of the improved display of the invention continues with reference to the attached technical drawings, which only have an illustrative, not limiting value, wherein:

in FIG. 4 the door panels are in closing position, in FIG. 5 the door panels are in partial opening position and in FIG. 6 the doors are in complete opening position;

DETAILED DESCRIPTION OF THE INVENTION

In the following description the parts that are identical or correspond to the parts described above with reference to the prior art are identified with the same numerals, omitting their detailed description.

With reference to FIGS. 3 to 8, a display (200) according to the invention is disclosed, which operates as a refrigerator, comprising hinging means to hinge the door panels (3) to said box frame (1).

Figure 7:
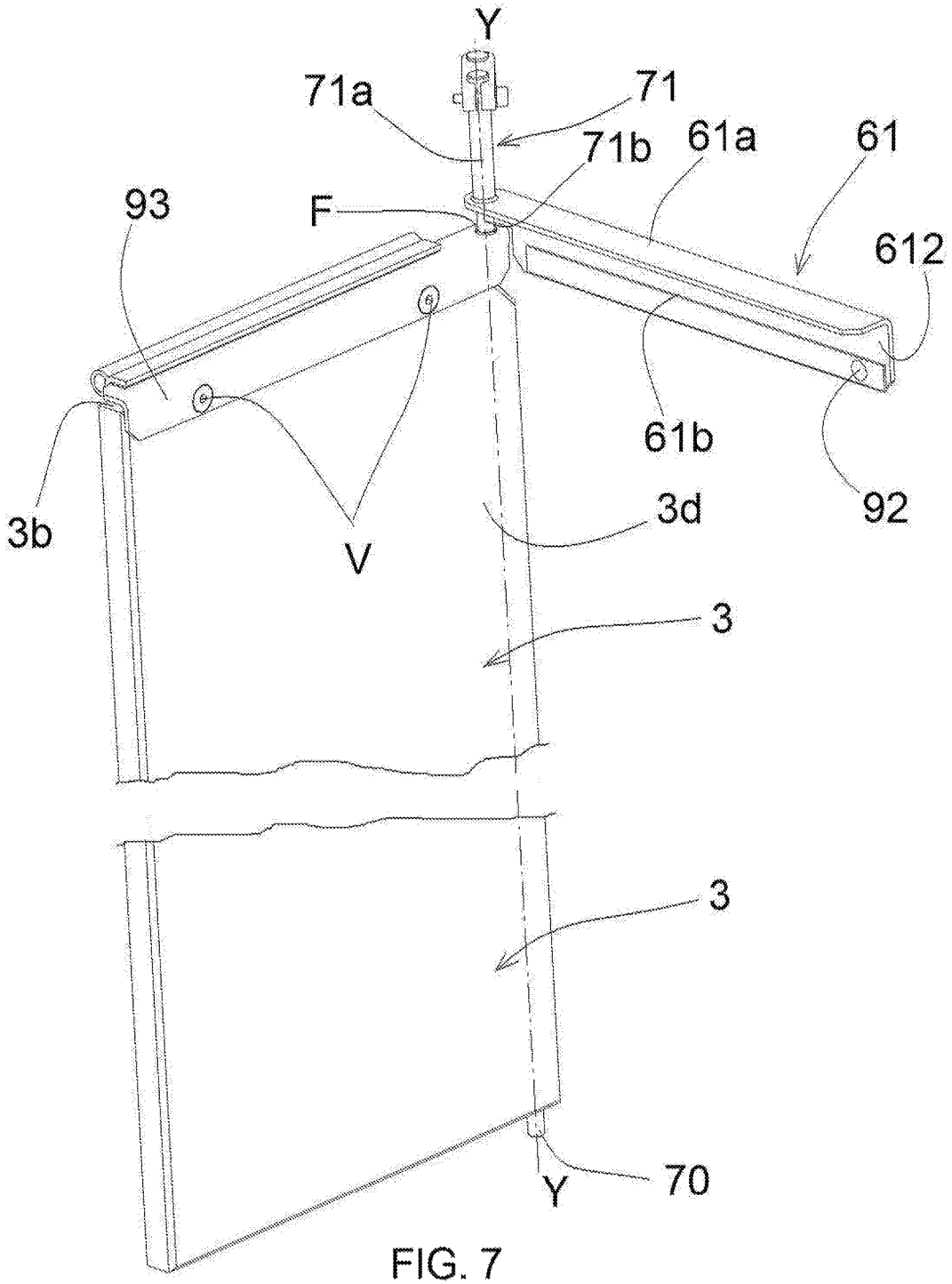
FIG. 7 is an axonometric view of the door panel, of the fast coupling/uncoupling means, of the hinging means and of the movement component according to a first embodiment of the invention.

With reference to FIG. 7, the display (200) comprises a movement component (61) that is coupled with the door panel (3) to actuate the door panel (3).

The movement component (61) is a bar intended to be stopped against an upper part of the door panel (3).

The movement component (61) has an overturned "L" cross section, comprising:

- a vertical portion (61*b*) comprising an abutting side (612) that is directed towards the door panel (3) when the door panel (3) is connected to said movement component (61);
- a horizontal portion (61*a*) that extends above the upper edge (3*b*) of the door panel (3) when the door panel (3) is connected to said movement component (61).

Said horizontal portion (61*a*) comprises a lower side (611) directed towards the upper edge (3*b*) of the door panel (3).

The horizontal portion (61*a*) and the vertical portion (61*b*) are connected perpendicularly.

The display (200) comprises fast coupling/uncoupling means (92, 93) to provide the fast coupling of the movement component (61) with the door panel (3) in order to actuate the door panel (3) by means of the actuation means (M), as well as the fast uncoupling of said movement component (61) from the door panel (3) in order to actuate said door panel (3) manually independently from the actuation means (M).

According to a preferred embodiment of the invention, said fast coupling/uncoupling means (92, 93) comprise magnetic retention means (92, 93) arranged on the door panel (3) and/or on the movement component (61).

In particular, said magnetic retention means (92, 93) advantageously comprise a magnet (92) fixed on the abutting side (612) of the vertical portion (61*b*) of the movement component (61), and a metal bracket (93) that is fixed on the first side (3*d*) of the door panel (3), in proximity to the upper edge (3*b*) of the door panel and cooperates with said magnet (92).

More precisely, when the door panel (3) is in closing position, said magnet (92) is stopped against said metal bracket (93).

Advantageously, said metal bracket (93) is fixed on the first side (3*d*) of the door panel (3) with screws (V).

According to an alternative embodiment of the invention, which is not shown in the attached figures, said fast coupling/uncoupling means (92, 93) can comprise a pair of magnets, of which a first magnet is fixed on the first side (3*d*) of the door panel (3), in proximity to the upper edge (3*b*) of the door panel (3), and a second magnet is fixed on the abutting side (612) of the movement component (61).

As shown in FIG. 7, the hinging means are configured in such manner that the door panels (3) rotate around an axis of rotation (Y-Y).

The hinging means comprise:

- a first pivoting pin (71) of the door panel (3) connected to the movement component (61);
- a second pivoting pin (70) fixed to the door panel (3) in coaxial position to the first pivoting pin (71) and rotating in idle in a hole obtained on the lower crosspiece (13).

Said first pivoting pin (71) comprises a first section (71*a*) connected to said actuation means (M) and to said movement component (61), and a second section (71*b*) revolvingly inserted in idle inside a hole (F) provided on the door panel (3).

More precisely, the axis of rotation (Y-Y) of each door panel (3) is advantageously vertical and the first pivoting (71) of each door panel (3) has the first section (71*a*) disposed above the horizontal portion (61*a*) of the movement component (61) and the second section (71*b*) interposed between the upper edge (3*b*) of the door panel and the horizontal portion (61*a*) of the movement component (61).

Figure 4:
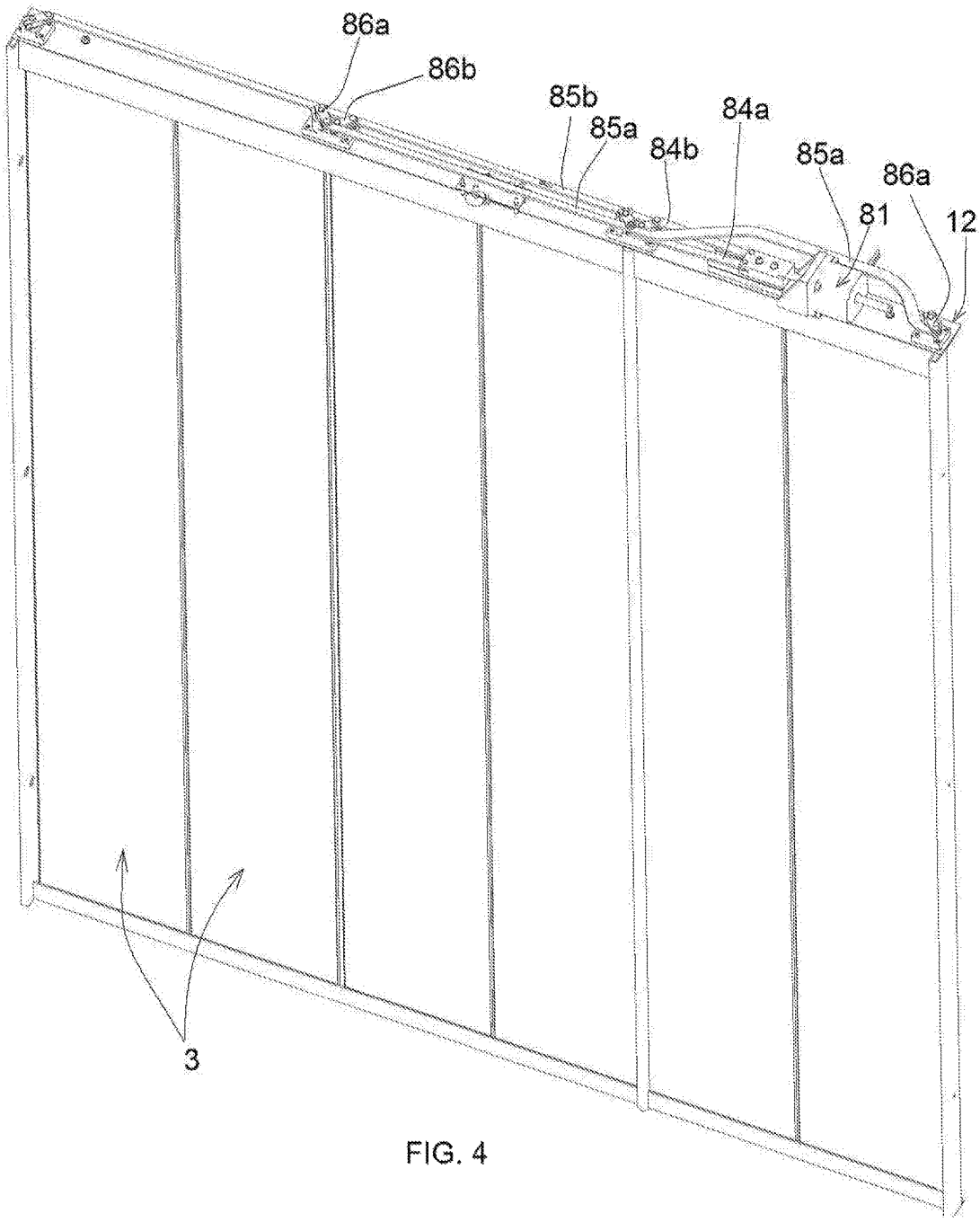
FIGS. 4, 5 and 6 are axonometric views of the actuation means and the door panels of the display according to the present invention in three different actuation steps of the door panels.
Figure 5:
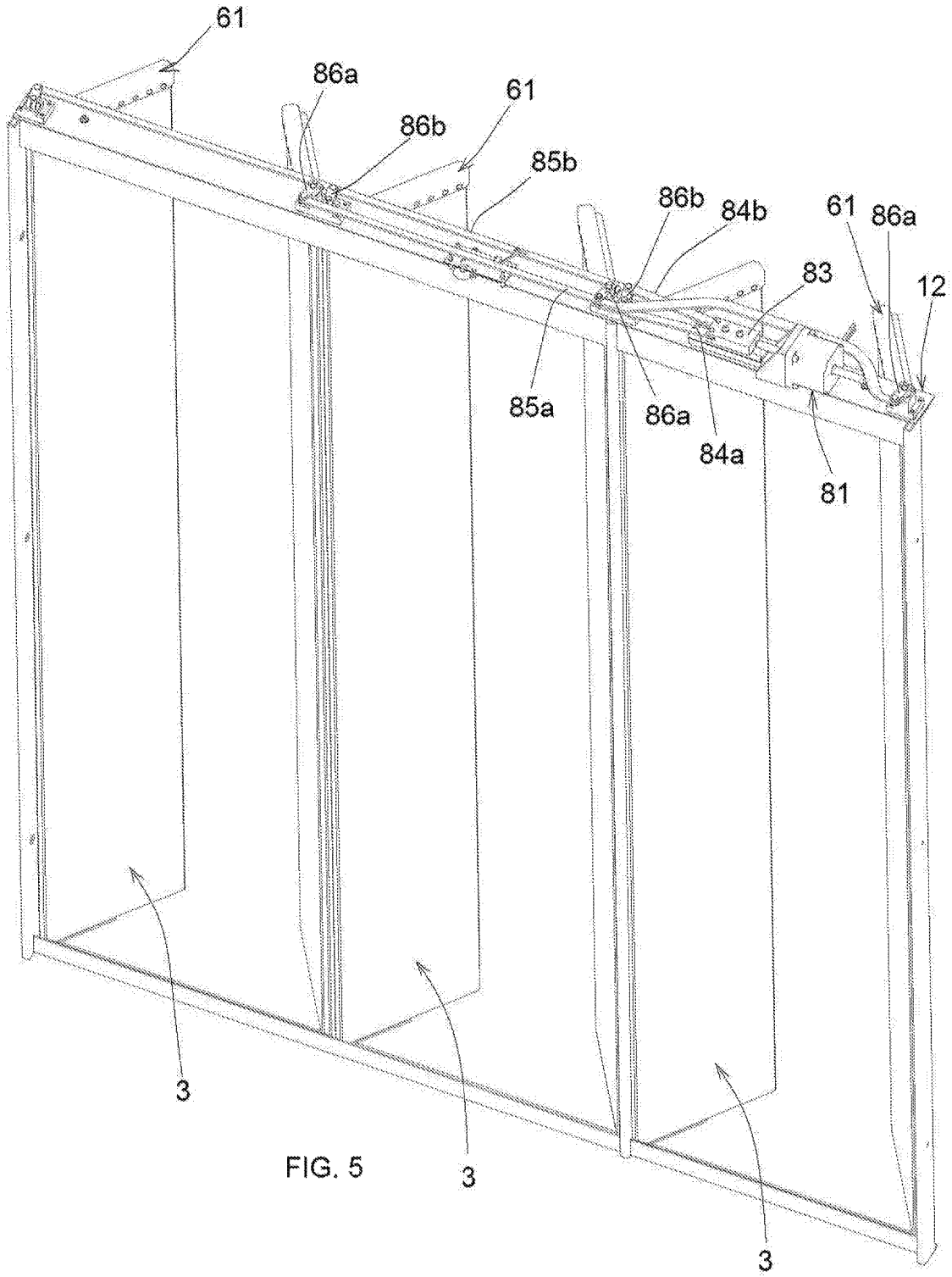
Figure 6:
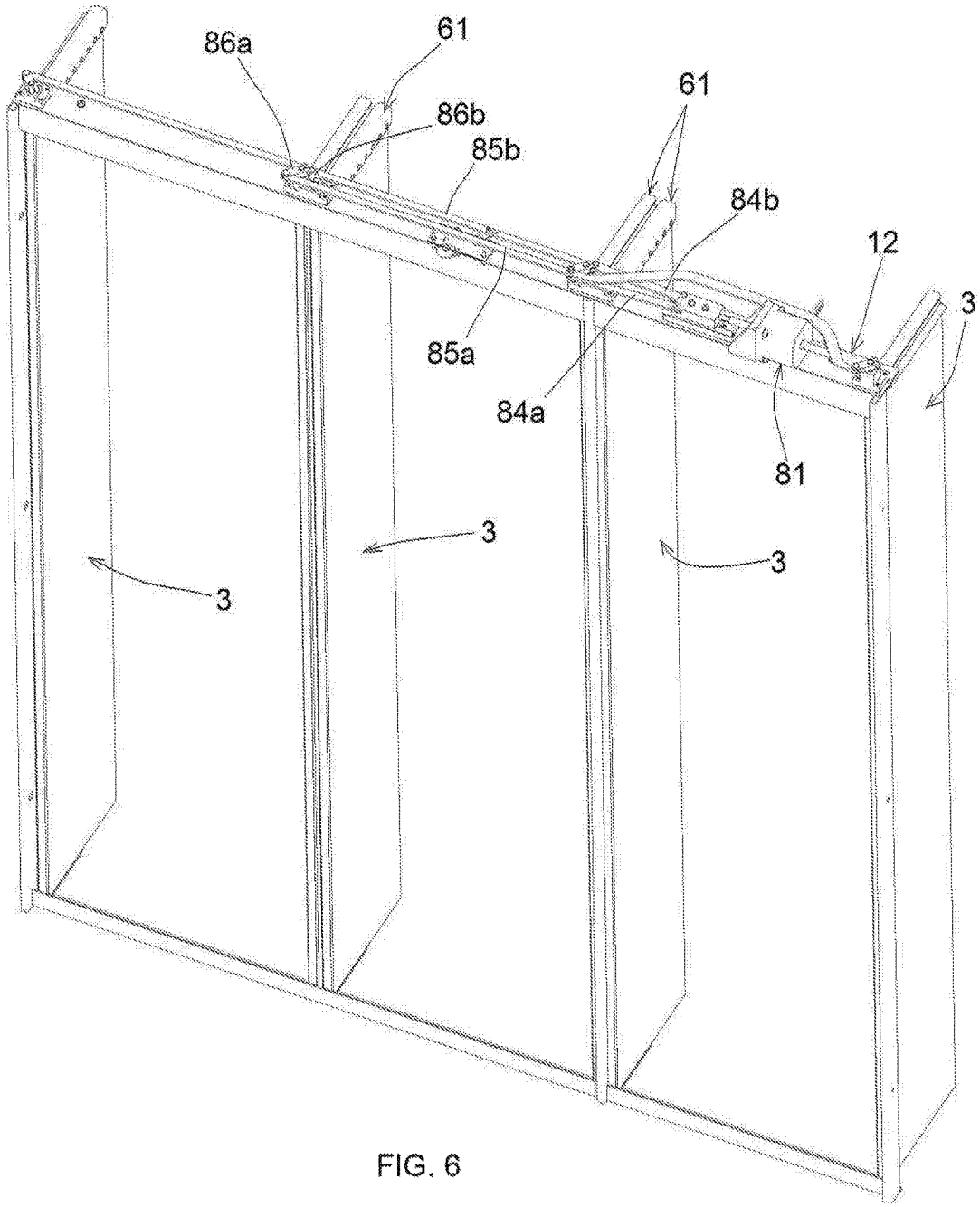

With reference to FIGS. 4, 5 and 6, the display (200) of the invention comprises actuation means (M) that actuate the hinging means to make each door panel (3) rotate around the axis of rotation (Y-Y).

The actuation means (M) simultaneously actuate all the door panels (3), are positioned on the upper crosspiece (12) of the box frame (1) and are connected to the first pivoting pin (71) of each door panel (3).

Figure 5A:
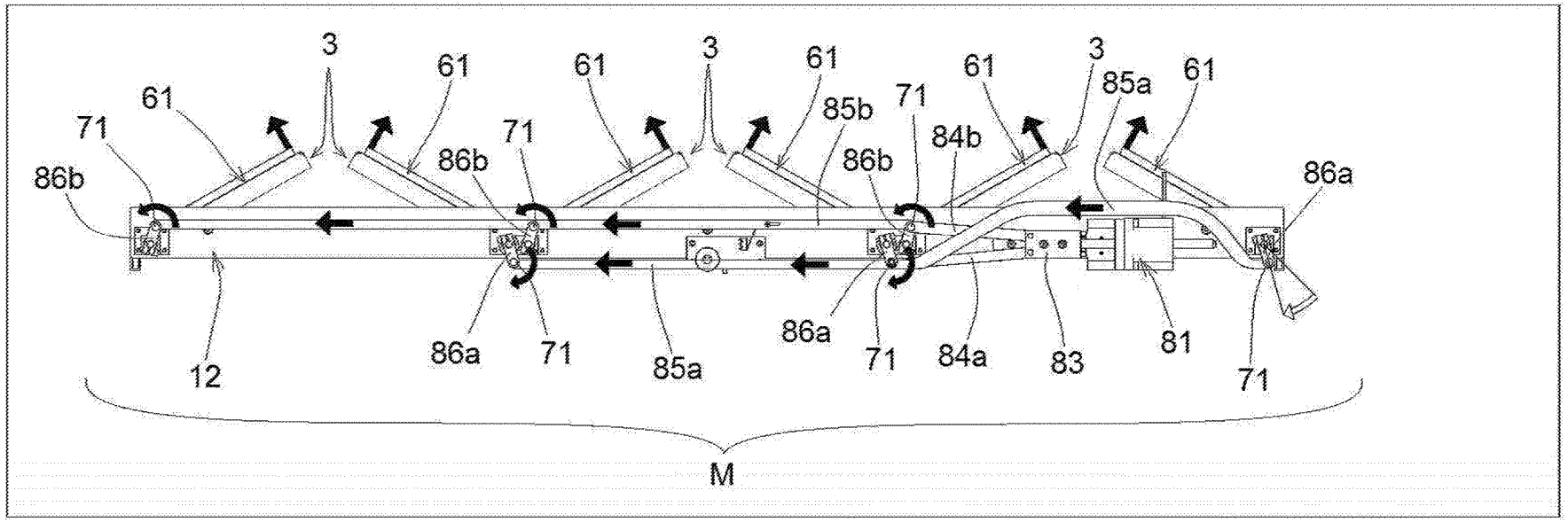
FIG. 5*a* is a top view of the actuation means of the door panels in the position shown in FIG. 5.

The actuation means (M) are seen from above in FIG. 5*a*, being all disposed above the upper crosspiece (12) of the box frame (1); in FIG. 5*a* the arrows indicate the movement made by all the parts of the actuation means (M).

With reference to FIG. 5*a*, said actuation means comprise:

- an electric motor (81);
- a slide (83) that is actuated by the electric motor (81) and makes alternate rectilinear travels;
- a first connecting rod (84*a*) connected to said slide (83);
- a second connecting rod (84*b*) connected to said slide (83);
- a first transmission lever (85*a*) connected to said first connecting rod (84*a*);
- a second transmission lever (85*b*) connected to said second connecting rod (84*b*);
- a set of first cranks (86*a*)—specifically, three first cranks (86*a*)—mutually connected by means of said first transmission lever (85*a*); a first crank (86*a*) of said first cranks (86*a*) being connected to said first connecting rod (84*a*); each first crank (86*a*) being connected to said first pivoting pin (71) of one of the door panels (3); all the door panels (3) being connected by means of the first pivoting pins (71) to the set of first cranks (86*a*), rotating in the same opening direction, specifically in clockwise direction, as shown in FIG. 5*a*
- a set of second cranks (86*b*)—specifically three second cranks (86*b*)—mutually connected by said second transmission lever (85*b*); a second crank (86*b*) of said second cranks (86*b*) being connected to said second connecting rod (84*b*); each second crank (86*b*) being connected to the first pivoting pin (71) of one of the door panels (3); all the door panels (3) being connected by means of the first pivoting pins (71) to the set of second cranks (86*b*) rotating in the same opening direction, specifically in anticlockwise direction, as shown in FIG. 5*a*.

The operation of the actuation means (M) is as follows:

- the rectilinear movement of the slide (83) is transmitted by means of the first (84*a*) and the second connecting rod (84*b*) to a first (86*a*) and a second crank (86*b*);
- said first (86*a*) and second crank (86*b*) transmit the motion respectively to the set of first cranks (86*a*) and to the set of second cranks (86*b*) by means of the first (85*a*) and the second transmission lever (85*b*).

The operation of the entire display (200) of the invention is described below, with reference to FIGS. 4, 5 and 6, to provide a better understanding of the structure of the display according to the invention and appreciate its advantages.

As soon as a user stands in front of the display:

- the detection means (R) of the display (200) of the invention detect the presence of the user in proximity to the door panel (3) of the display (200) and send an activation signal to the electric motor (81);
- the electric motor (81) actuates the slide (83);
- by means of the aforementioned kinematic mechanism composed of connecting rods (84*a*,84*b*), cranks (86*a*, 86*b*) and transmission levers (85*a*,85*b*), the slide (83) actuates all the first pivoting pins (71);
- by rotating, all the first pivoting pins (71) of the door panels (3) actuate all the movement components (61);
- all the movement components (61) actuate all the door panels (3).

A first advantage can be found when one of the following problems occurs:

- incorrect operation of the actuation means (M);
- blocking of the actuation means (M);
- breakdown or malfunctioning of the detection means®.

In the past, the door panels (3) were firmly connected to the actuation means (M), whereas in the present invention each door panel (3) can be always actuated, being released from the corresponding movement component (61); in order to do this, it is sufficient to apply a force on the door panel (3) that is capable of overcoming the attraction force between the magnet (92) and the metal bracket (93) that removably connect the door panel (3) to the corresponding movement component (61), and then manually rotate the door panel (3) that is freely pivoted with respect to the upper crosspiece (12) of the box frame (1).

Another circumstance in which the structure of the display (200) of the invention shows its advantages is when the door panels (3) close due to a malfunctioning of the detection means (R), while a user is picking a product that is contained in the interior of the display (200).

In such a situation the door panels (3), which are pushed by the actuation means (M) towards the closing position, interrupt the closing travel, being released from the movement component (61) as soon as the vertical lateral border (3*a*) of the door panel (3) intercepts the user's arm.

An additional advantage of the display (200) consists in the easy mounting and dismounting of the door panels (3), said door panels (3) being hinged to the display (200) only by means of the second pivoting pin (70) and the second section (71*b*) of the first pivoting pin (71).

Furthermore, an additional advantage is represented by the fact that the display (200) comprises only one electric motor (81) used to actuate all the panel doors (3). Having only one electric motor (81), the door panels (3) are moved in a synchronous manner, without having to be calibrated either electrically or electronically.

Figure 8:
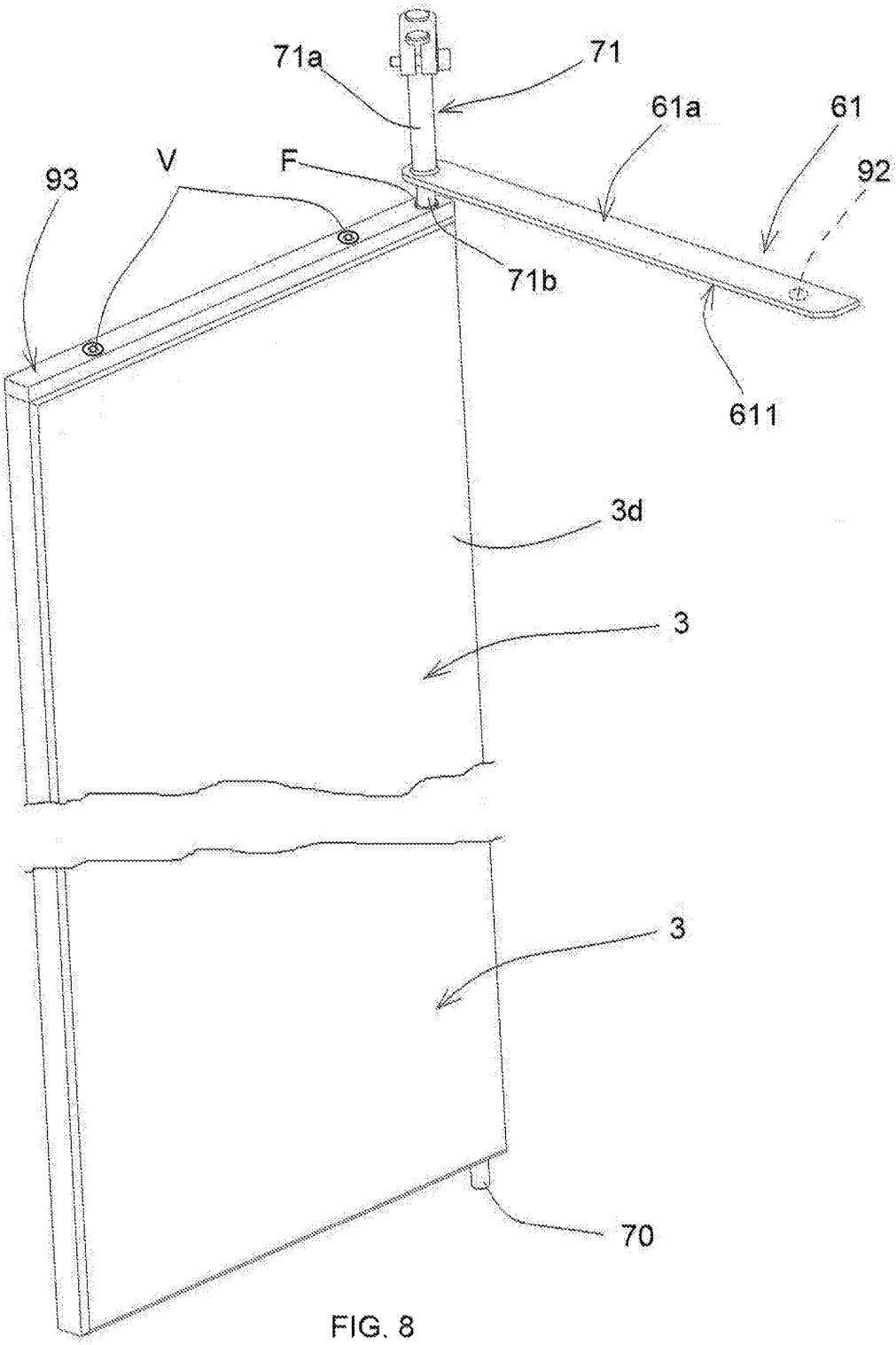
FIG. 8 is an axonometric view of the door panel, of the fast coupling/uncoupling means, of the hinging means and of the movement component to a second embodiment of the invention.

According to an additional embodiment of the invention, which is shown in FIG. 8, the movement component (61) is a plate and comprises a horizontal portion (61*a*) that extends above the upper edge (3*b*) of the door panel.

The horizontal portion (61*a*) comprises a lower side (611) directed towards the upper edge (3*b*) of the door panel (3).

The fast coupling/uncoupling means (92, 93) comprise magnetic retention means and, in particular, advantageously comprise a magnet (92) fixed on the lower side (611) of the horizontal portion (61*a*) of the movement component (61), and a metal bracket (93) fixed on the upper edge (3*b*) of the door panel (3).

Such an arrangement of the fast coupling/uncoupling means (92, 93) provides for an additional advantage, which is represented by the fact that the door panels (3) can be released from the corresponding movement component (61) in both directions, both in opening and closing direction.

Otherwise said, if a door panel (3) is blocked in complete or partial opening position because of malfunctioning, the user could close the door panels (3) by pulling them towards him/her and releasing the door panel (3) from the corresponding movement component (61).

Figure 1:
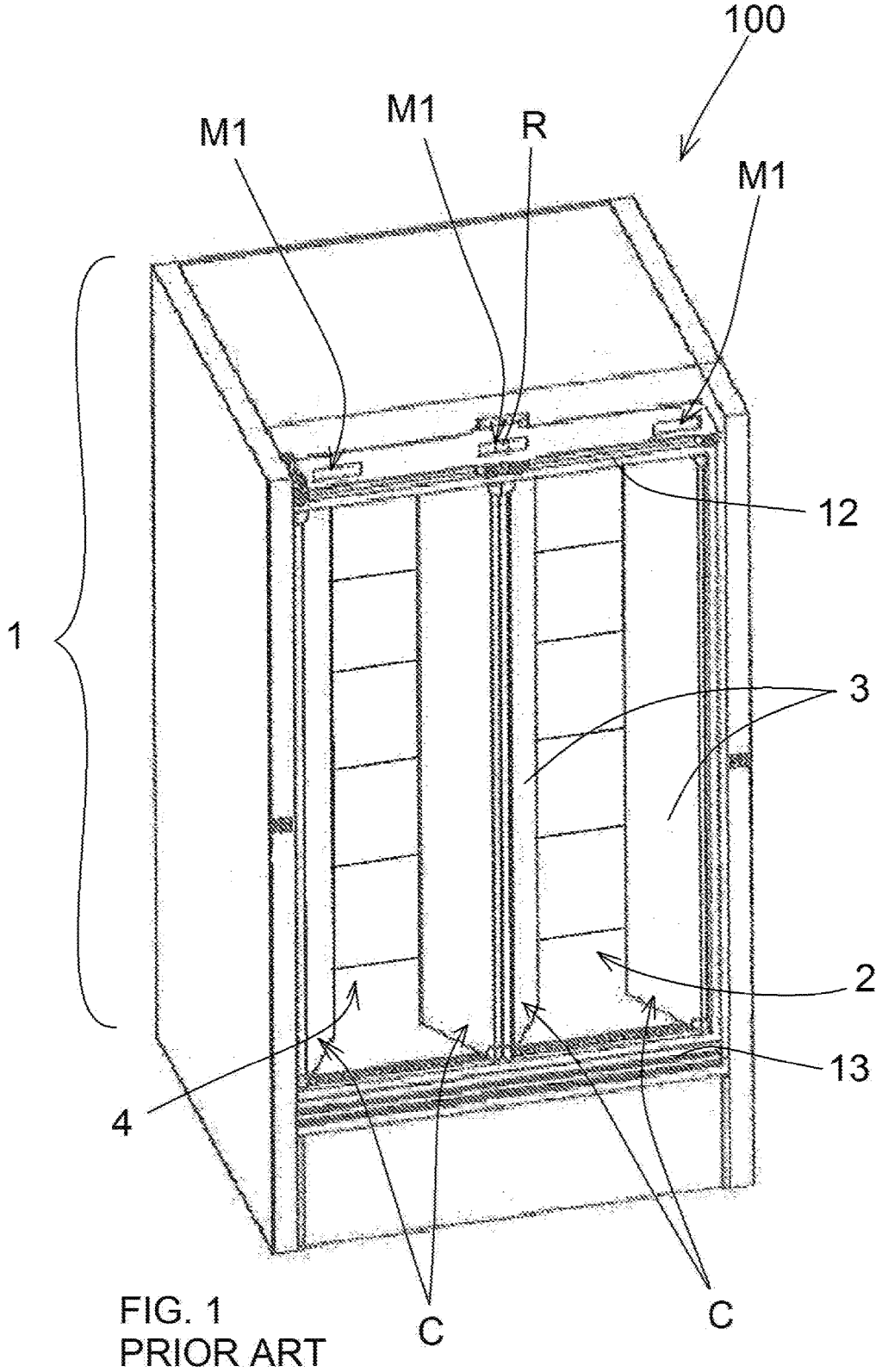
FIG. 1 PRIOR ART
FIG. 1 is a perspective view of a display according to the prior art.
Figure 2:
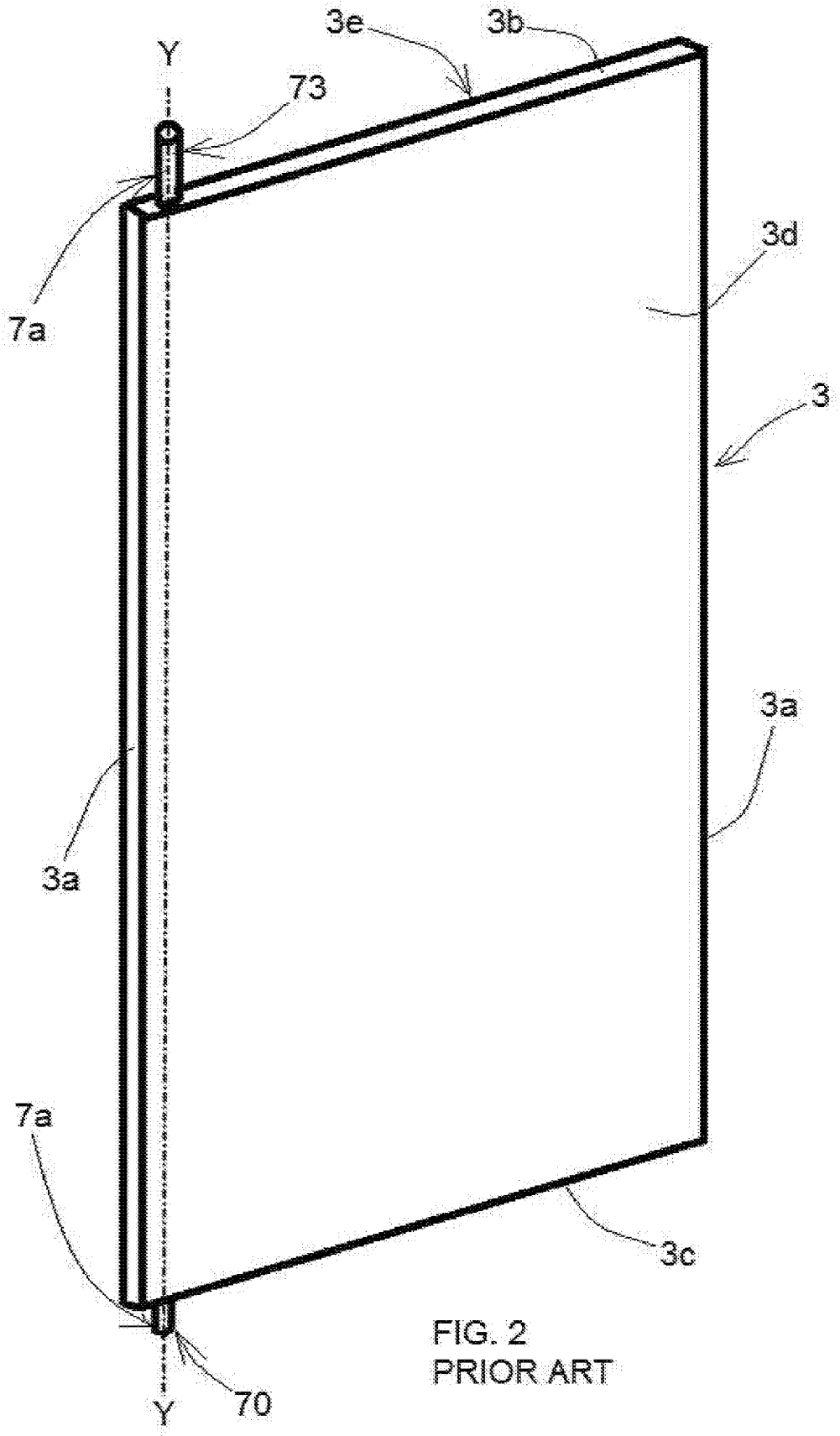
FIG. 2 PRIOR ART
FIG. 2 is a perspective view of a door panel of the display of FIG. 1.
Figure 3:
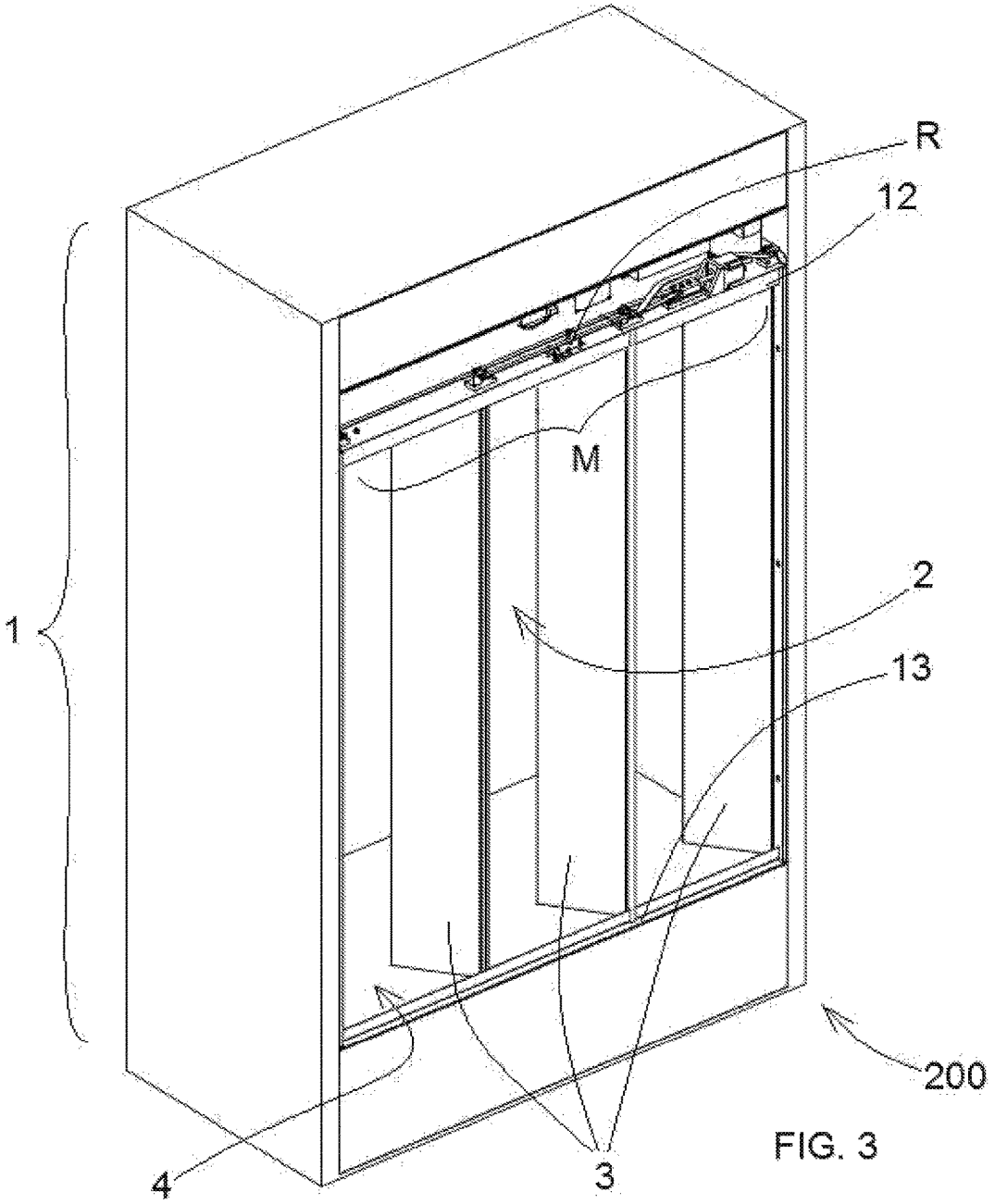
FIG. 3 is an axonometric view of the display of the invention, wherein the door panels are in partially opening position.

With reference to FIG. 3, the display (200) advantageously comprises a switch (I) that can be operated manually by a user to actuate the door panels (3).

In particular, said switch (I) is configured in such a way to send an activation signal to the actuation means (M) that actuate the hinging means to rotate each door panel (3) around its axis of rotation (Y-Y).

I claim:

1. A display apparatus comprising:

A box frame having a compartment and an opening to access said compartment;

at least one pair of revolving door panels adapted to at least partially close said opening of said box frame, each door panel of said at least one pair of revolving door panels being connected to said box frame so as to have a closing position and an opening position;

a hinge connecting each door panel of said at least one pair of revolving door panels to said box frame, said hinge causing the door panel to rotate around an axis of rotation, said hinge having a first pivoting pin that connects and hinges the door panel to said box frame; and an actuator cooperative with said hinge so as to rotate the door panel around said axis of rotation, said actuator comprising:

an electric motor;

a slide that is actuated by said electric motor so as to travel rectilinearly;

a connecting rod connected to said slide;

a pair of cranks in which one of said pair of cranks is connected to said connecting rod, each crank of said pair of cranks being connected to said first pivoting pin such that each door panel is connected to only one crank of said pair of cranks; and a transmission lever connecting said pair of cranks.

2. The display apparatus of claim 1, the door panels of said at least one pair of door panels being counter-rotating with respect to each other.

3. The display apparatus of claim 2, said connecting rod comprising first and second connecting rods connected to said slide, said transmission lever comprising a first transmission lever connected to said first connecting rod and a second transmission lever connected to said second connecting rod, said pair of cranks comprising a set of first cranks mutually connected by said first transmission lever, a first crank of said first set of cranks being connected to said first connecting rod, each first crank being connected to said first pivoting pin, said pair of cranks further comprising a set of second cranks mutually connected by said second transmission lever, a second crank of said set of second cranks being connected to said second connecting rod, each second crank being connected to the first pivoting pin of another door panel of said at least one pair of revolving door panels.

4. The display apparatus of claim 1, said at least one pair of revolving door panels comprising multiple pairs of revolving door panels which rotate toward an interior of said compartment.

5. The display apparatus of claim 1, said axis of rotation being vertical.

6. The display apparatus of claim 1, further comprising:

a movement compartment coupled to each door panel so as to move each door panel, said movement compartment being coupled to said actuator so be activated by said actuator; and a coupler that couples said movement compartment with the door panel, said coupler adapted to uncouple said movement compartment from the door panel in order to allow the door panel to move manually independently of said actuator.

7. The display apparatus of claim 6, said first pivoting pin being connected to said movement compartment and to said actuator.

8. The display apparatus of claim 6, said first pivoting pin comprising:

a first section connected to said actuator and to said movement compartment; and a second section revolvingly inserted into a hole formed on the door panel.

9. The display apparatus of claim 6, said coupler comprising a magnetic retainer disposed on said movement compartment or in the door panel.

10. The display apparatus of claim 6, said movement compartment having a bar with an inverted L-shaped cross section, said bar having a vertical portion with an abutting side that is directed to said door panel, said coupler comprising a magnet fixed on said abutting side and a metal bracket fixed to the door panel in proximity to an upper edge of the door panel.

11. The display apparatus of claim 6, said movement compartment having a plate that has a horizontal portion that extends above an upper edge of the door panel, said horizontal portion having a lower side directed toward the upper edge of the door panel, said coupler comprising a magnet fixed onto said lower side of said horizontal portion and a metal bracket fixed onto the upper edge of the door panel.

12. The display apparatus of claim 1, further comprising:

a detector adapted to detect a presence of a user in proximity to said at least one pair of revolving door panels, said detector cooperative with said actuator so as to send an activation signal to said actuator in order to actuate the hinge to rotate the door panel around the axis of rotation.

13. The display apparatus of claim 1, further comprising:

a switch that is manually operated in order to send an activation signal to said actuator in order to activate said hinge so as to rotate the door panel around the axis of rotation.

* * * * *